US006935967B2

(12) United States Patent
Mahaffey et al.

(10) Patent No.: US 6,935,967 B2
(45) Date of Patent: Aug. 30, 2005

(54) GOLF CLUB SET WITH PROGRESSIVE WEIGHT PAD

(75) Inventors: Steven J. Mahaffey, Belchertown, MA (US); Ryan Roach, Northampton, MA (US); Ronnie F. McGraw, Fort Worth, TX (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/458,491

(22) Filed: Jun. 10, 2003

(65) Prior Publication Data

US 2004/0254027 A1 Dec. 16, 2004

(51) Int. Cl.[7] ..... A63B 53/04
(52) U.S. Cl. ..... 473/291; 473/349
(58) Field of Search ..... 473/290–291, 473/324, 349–350, 342, 332; D21/747

(56) References Cited

U.S. PATENT DOCUMENTS

| | | | | | |
|---|---|---|---|---|---|
| 1,188,479 | A | * | 6/1916 | Park | 473/331 |
| D137,813 | S | * | 5/1944 | Newsome | D21/747 |
| 3,059,926 | A | * | 10/1962 | Johnstone | 473/291 |
| D299,505 | S | * | 1/1989 | Honma | D21/750 |
| D319,089 | S | * | 8/1991 | Mendralla | D21/750 |
| 5,295,686 | A | | 3/1994 | Lundberg | |
| 5,356,138 | A | * | 10/1994 | Chen et al. | 473/291 |
| 5,375,840 | A | | 12/1994 | Hirsch et al. | |
| 5,413,336 | A | * | 5/1995 | Iwanaga | 473/291 |
| D368,753 | S | | 4/1996 | Blough et al. | |
| 5,658,209 | A | | 8/1997 | Blakemore | |
| 5,921,869 | A | | 7/1999 | Blough et al. | |
| 6,120,388 | A | | 9/2000 | Blough et al. | |
| D434,462 | S | * | 11/2000 | Reed et al. | D21/747 |
| 6,179,726 | B1 | * | 1/2001 | Satoh et al. | 473/290 |
| 6,290,607 | B1 | | 9/2001 | Gilbert et al. | |
| D449,866 | S | * | 10/2001 | Miller | D21/747 |
| D469,832 | S | * | 2/2003 | Bode et al. | D21/747 |
| 6,592,469 | B2 | * | 7/2003 | Gilbert | 473/350 |

* cited by examiner

*Primary Examiner*—Stephen Blau
(74) *Attorney, Agent, or Firm*—Lawrence E. Laubscher, Jr.; Michael A. Catania; Elaine H. Lo

(57) ABSTRACT

A set of golf club irons of the blade type is characterized by a weight pad behind the impact area of the club face which progressively increases in height through the set from the long irons to the short irons. In addition, the thickness of the sole portion of each head increases through the set to progressively increase the weight at the bottom of the club heads. The clubs provide improved feel to the golfer which enable the golfer to work the ball more easily during execution of a golf shot.

5 Claims, 7 Drawing Sheets

FIG. 1
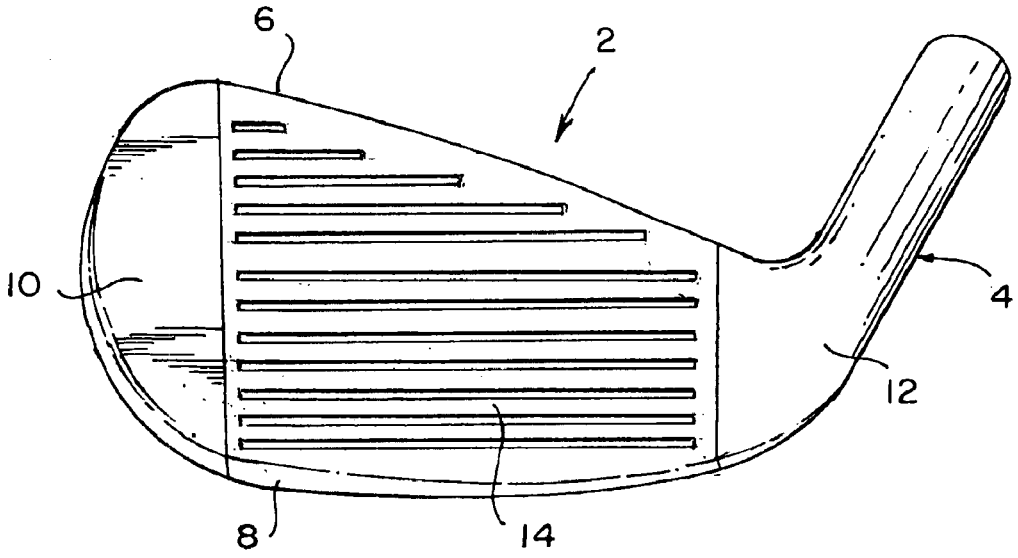
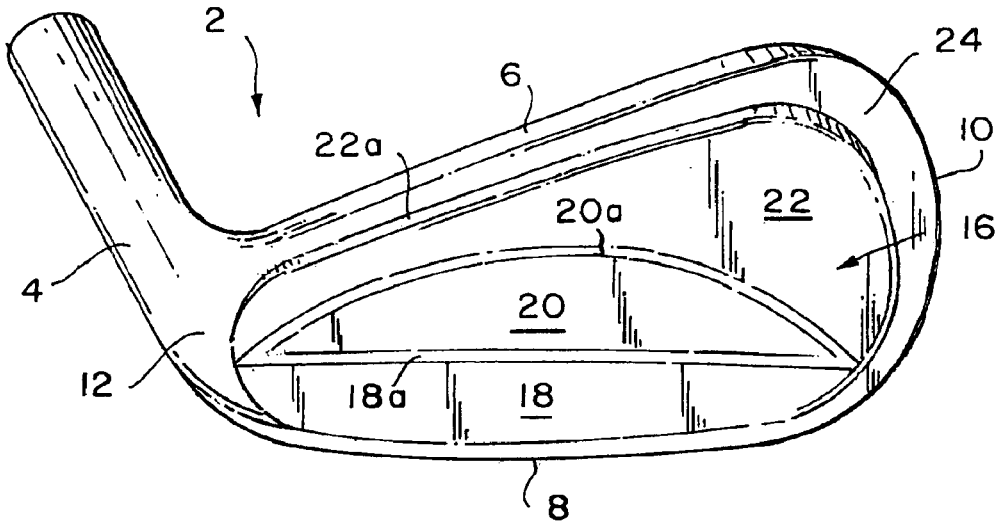
FIG. 2

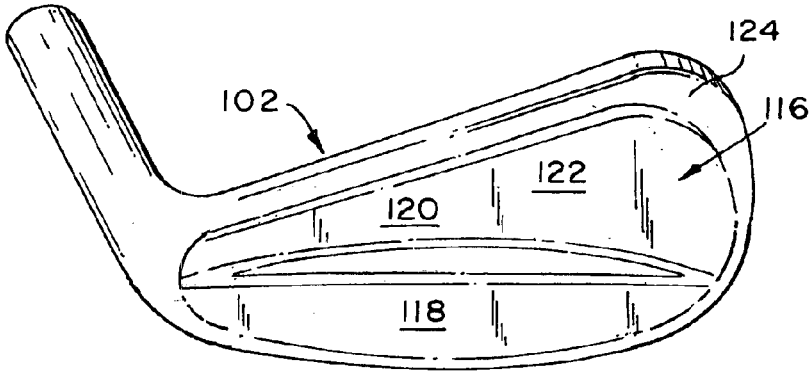
FIG. 7
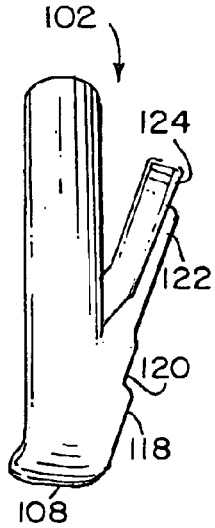
FIG. 8
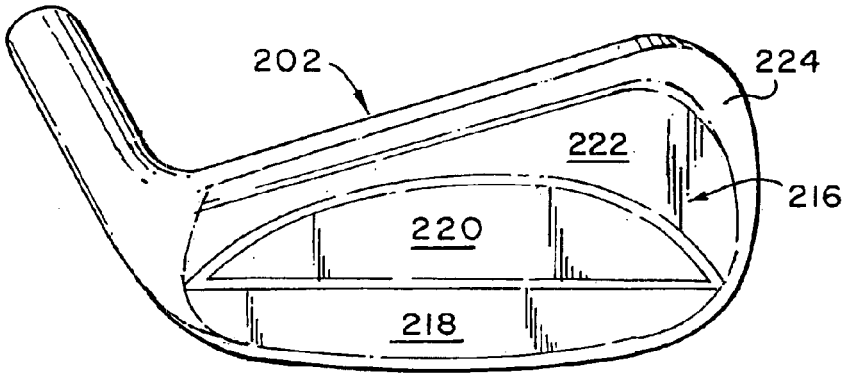
FIG. 9
FIG. 10
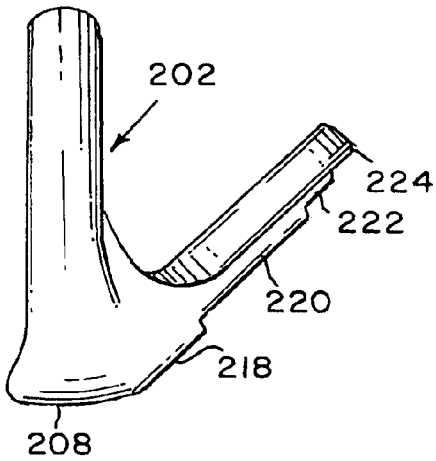

GOLF CLUB SET WITH PROGRESSIVE WEIGHT PAD

BACKGROUND OF THE INVENTION

Sets of golf club irons comprise a plurality of different clubs having different lofts and centers of gravity. Most sets comprise a 3-iron through a pitching wedge, while other sets include a 1-iron and extend through wedges of increasing lofts. The lower number clubs have lower lofts, and the loft progressively increases through the set.

Iron type golf clubs generally have either a blade or cavity back configuration. A blade-configured club has a rear surface which does not contain any cavities or depressions. Cavity back clubs are characterized by redistributing the weight of the club head to around the perimeter thereof. Such clubs are thus thicker around the rear perimeter of the club to define a cavity behind the striking area of the club face.

Most amateur golfers find that cavity back perimeter-weighted clubs are easier to hit. This is due to the fact that perimeter-weighted clubs increase the moment of inertia which increases stability of the club head and lessens head rotation that imparts side spin on a struck golf ball. With perimeter-weighted clubs, a golfer can hit a straighter shot, even when the ball is not struck in the center or "sweet spot" of the club face.

While perimeter-weighted clubs have many benefits for the amateur golfer, there are drawbacks as well. One such drawback is that the perimeter weighting tends to lower the center of gravity for each club. While this increases the trajectory of ball flight, there is a corresponding loss of distance to a struck golf ball. Another drawback is that perimeter-weighted clubs do not provide the golfer with the same degree of feel from a shot as do blade type golf clubs.

The present invention relates to an improved set of golf clubs of the blade type which are easier to hit and which provide a better flight trajectory than traditional blade club heads.

BRIEF DESCRIPTION OF THE PRIOR ART

It is known in the art to raise the center of gravity through a set of golf club irons as evidenced by the U.S. patents to Blough et al. U.S. Pat. Nos. 5,921,869 and 6,120,388 and to Gilbert et al. U.S. Pat. No. 6,290,607.

The Blough et al. patents disclose sets of perimeter-weighted golf clubs in which the weight distribution is changed through the set to control the location of the center of gravity and to control the polar moment of inertia to provide graded performance for each club head within the set.

The Gilbert et al. patent also discloses a set of perimeter-weighted cavity back golf club heads with adjustable weight distribution to control the center of gravity. Specifically, a cavity mass of weight is arranged within the rear cavity of each club head, and the mass or weight can be changed so that the center of gravity rises from the longer irons to the short irons.

While the club heads disclosed in these references perform satisfactorily, they are still cavity back heads rather than blades. The present invention was developed in order to provide a set of blade-type golf club irons in which mass is concentrated behind the impact area of each club head to raise the center of gravity through the set of clubs and to provide improved feel.

SUMMARY OF THE INVENTION

Accordingly, the present invention relates to a set of golf club heads of the blade type each of which includes a body having top, bottom, toe, and heel portions, a front striking face and a rear surface. According to a preferred embodiment, the rear surface of each club head includes first, second, third, and fourth portions which progressively decrease the thickness of the club head body relative to the striking face. The first portion is the thickest portion of the club head and is adjacent to the club head bottom portion. The second portion is arranged above the first portion and has a convex upper edge extending between the toe and heel portions of the club. The third portion is arranged above the second portion and has an upper edge spaced from the top edge of the club head. The fourth portion is the thinnest portion and is arranged above the third portion and has a surface that extends to the rear edge of the top portion. The upper edge of the first portion extends generally linearly between the toe and heel portions of the club head body. The height and thickness of the body rear surface second portion increases through the set of clubs from the lower numbered clubs to the higher numbered clubs. The progressive changes in configuration of the second portion raises the center of gravity of each club through the set and increases the mass located behind the impact area of the striking face.

The thickness of the rear surface first portion also increases as the thickness of the bottom portion increases through the set of clubs.

Preferably, all of the clubs of the set are formed of forged metal to improve the feel provided to the golfer when executing a golf shot.

BRIEF DESCRIPTION OF THE FIGURES

Other objects and advantage of the invention will become apparent from a study of the following specification when viewed in the light of the accompanying drawing, in which:

FIGS. 1 and 2 are front perspective and rear elevation views, respectively, of a mid-iron golf club head of a set of golf clubs according to the invention;

FIGS. 7 and 8 are rear and right side elevation views, respectively, of a low-iron golf club of the set of golf clubs according to the invention;

FIGS. 9 and 10 are rear and right side elevation views, respectively, of a high-iron golf club of the set of golf clubs according to the invention;

DETAILED DESCRIPTION

Figure 3:
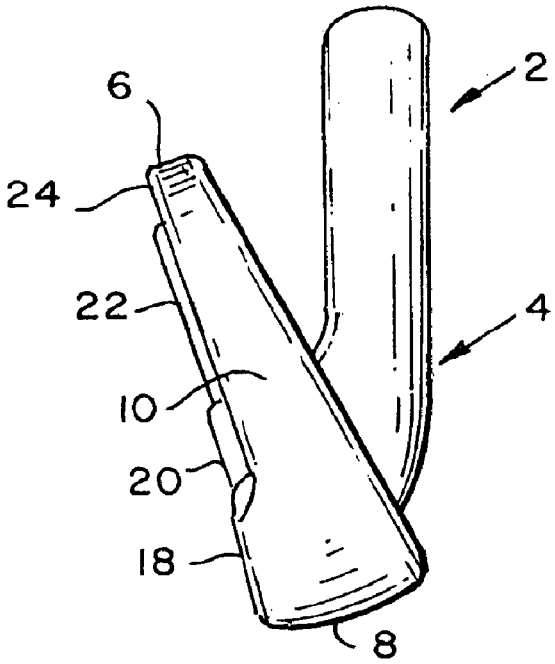
FIGS. 3 and 4 are left and right side elevation views, respectively, of the golf club head of FIG. 1.

The present invention relates to a set of golf clubs of the blade type. A mid-iron golf club head 2 such as a 5-iron of the set of clubs according to a preferred embodiment is shown in FIGS. 1–6. The club head includes a body 4 having top 6, bottom 8, toe 10 and heel 12 portions. At the front of the body is a grooved striking face 14 as shown in FIGS. 1 and 5. Behind the striking face is a rear surface 16 as shown in FIGS. 2 and 6. A blade-type golf club head does not contain any cavities or depressions in the rear surface as distinguished from perimeter-weighted clubs which contain one or more rear cavities.

Figure 4:
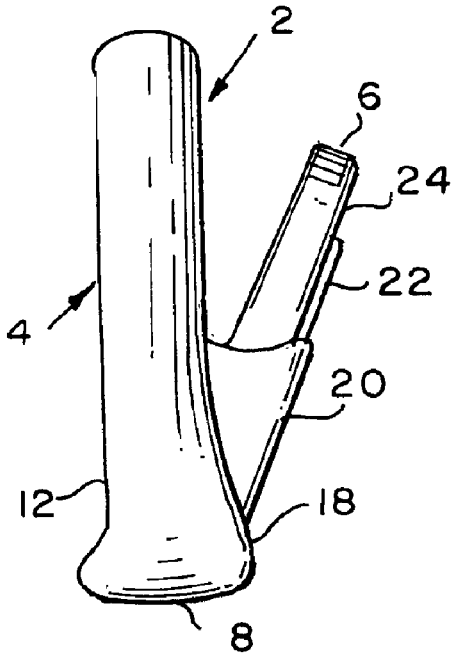
Figure 5:
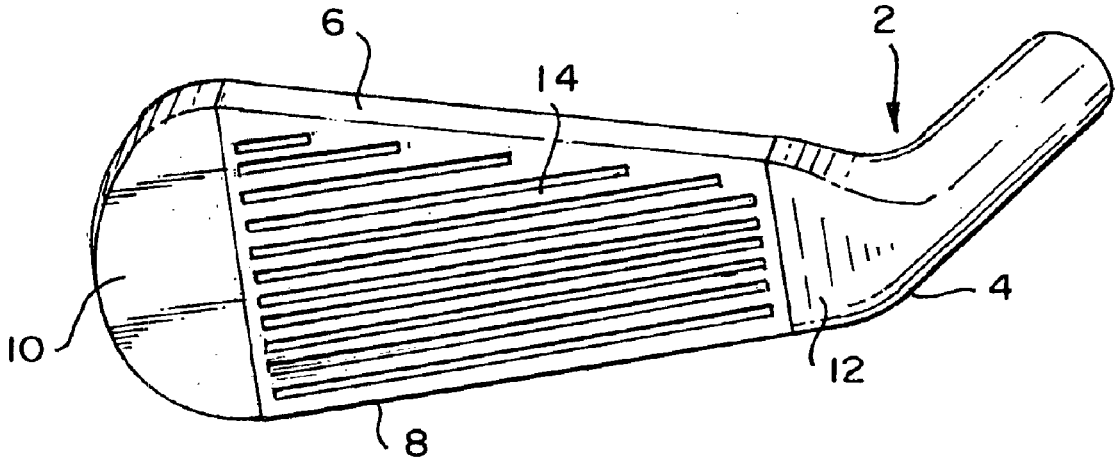
FIGS. 5 and 6 are top and bottom elevation views, respectively, of the golf club head of FIG. 1.
Figure 6:
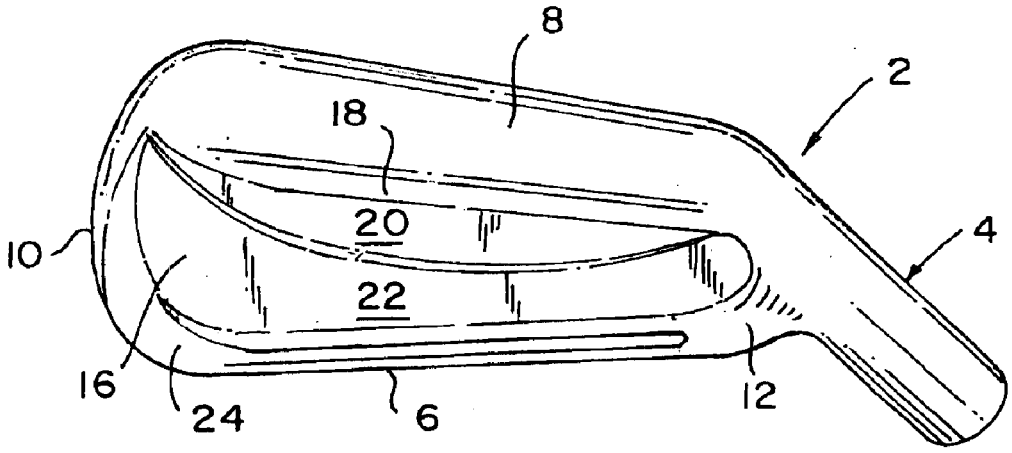

The rear surface of the club head of FIGS. 1–6 includes four distinct portions which progressively increase the thickness of the head body from the top portion 6 to the bottom portion 8. Referring to FIG. 2, the first portion 18 of the rear surface 16 extends along the sole or bottom portion 8 of the club. The upper edge 18*a* of the first portion extends generally linearly between the heel 12 and toe 10 portions of the club head. The first portion 18 is the thickest portion of the club head from front to rear as shown in FIGS. 3 and 4.

The second portion 20 of the rear surface is arranged above the first portion. It is characterized by a convex upper edge 20*a* extending between the heel 12 and toe 10 portions of the club head. At its highest point, the upper edge of the second portion extends to and preferably above the impact area of the club face. The thickness of the second portion is less than the thickness of the head through the first portion 18 as shown in FIGS. 3 and 4.

The third portion 22 of the rear surface is arranged above the second portion. The upper edge 22*a* of the third portion is spaced from and extends generally parallel to the upper edge of the club head as shown in FIG. 2. The thickness of the club head through the third portion 22 of the rear surface is less than the thickness of the head through the second portion 20.

The fourth portion 24 extends along the top of the club head body and around the upper portion of the toe portion. The fourth portion defines the thinnest portion of the club head and provides an improved visual appearance of the club head to the golfer for alignment.

A characterizing feature of the invention is that the height of the second portion 20, which can be considered as a weight pad behind the impact area of the striking face, increases through the set of clubs. This can been seen from FIGS. 7 and 9.

In FIGS. 7 and 8 there is shown the club head of a long iron 102 such as a 2-iron from the set of golf club heads according to the invention. The rear surface 116 of the head body includes first 118, second 120, third 122 and fourth 124 portions similar to those described above in connection with the club head 2 of FIGS. 1–6. However, the height of the second portion 120 is less than that of the second portion 20 of the mid-iron club head 2.

In FIGS. 9 and 10 there is shown the club head of a short iron 202 such as a pitching wedge from the set of golf club heads according to the invention. The rear surface 216 of the head body includes first 218, second 220, third 222 and fourth 224 portions similar to those of the club heads 2 and 102 described above. However, the height of the second portion 220 is greater than that of the second portion 20 of the mid-iron club head 2.

That is, the higher the loft or number of the club, the higher the second portion or weight pad extends up the rear surface of the club head body. This raises the center of gravity of the heads of the set from the long irons to the short irons and also locates more mass directly behind the impact area for improved feel.

Another feature of the clubs of the set is that the thickness of the heads from the first portion or "muscle back" to the fourth portion decreases through the set.

Figure 12:
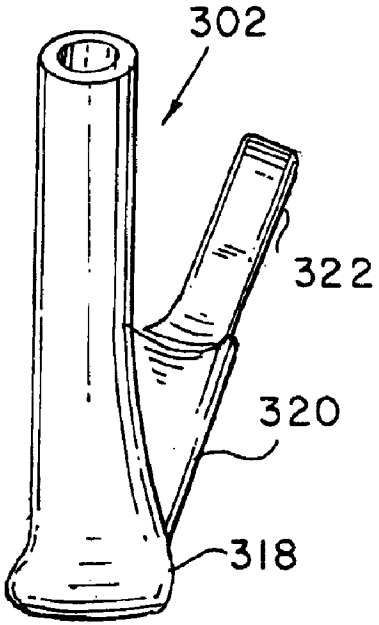
FIGS. 11 and 12 are rear and right side elevation views, respectively, of a golf club according to a second embodiment of a set of golf clubs according to the invention.
Figure 11:
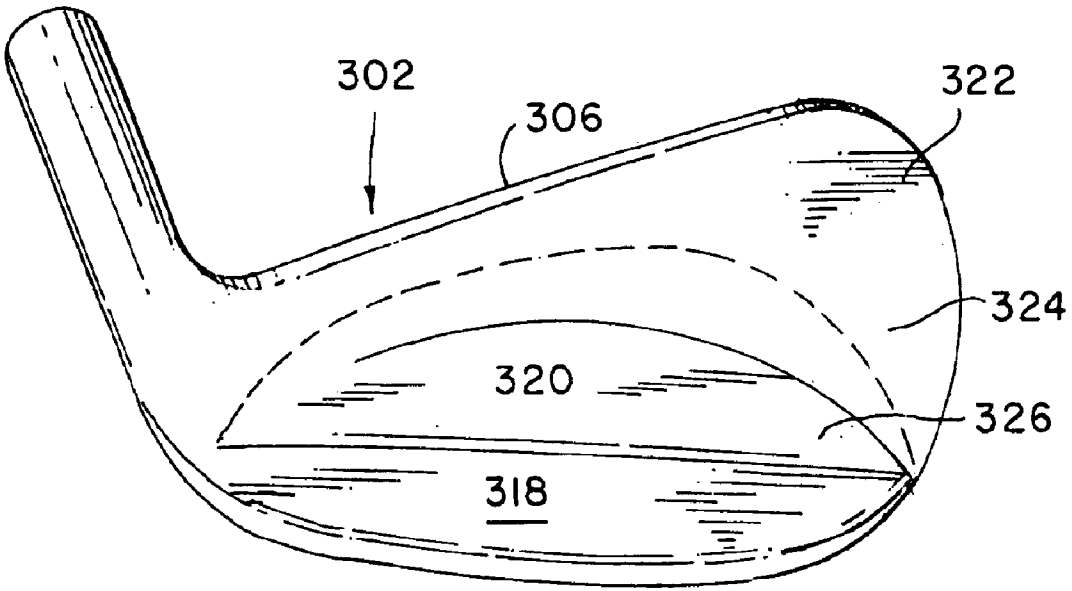

Referring now to FIGS. 11 and 12, there is shown a five iron golf club head 302 according to a second embodiment of the invention. The head is similar to that of FIGS. 1–6 except that the head includes three portions of decreasing thickness rather than four. Essentially, the fourth portion of the head of FIGS. 1–6 is eliminated in the embodiment of FIGS. 11 an 12. Thus, the head comprises a first portion 318, a second portion 320 and a third portion 322 of a decreasing thickness, with the third portion 322 extending continuously to the top edge 306 of the head. The vertical extent of the second portion 320 increases through the set as in the preferred embodiment. The height of the second portion for a low club is shown by the line 326 and that of a high club is shown by the dashed line 324.

Figure 13:
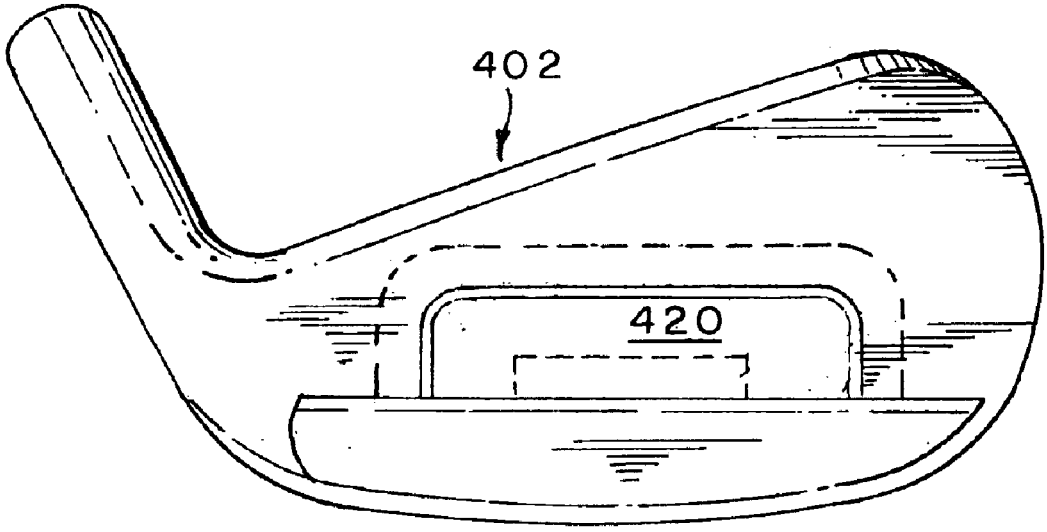
FIGS. 13, 14, 15, and 16 are rear elevation views of third, fourth, fifth and sixth embodiments, respectively, of the invention.
Figure 14:
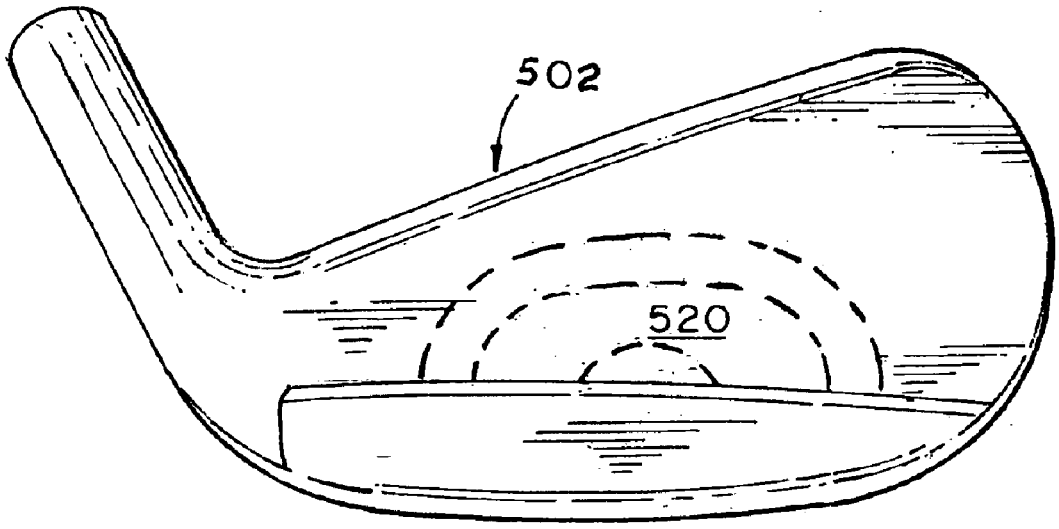

In FIGS. 13 and 14 are shown alternate configurations for the third portion. In the preferred embodiment of FIGS. 1–6, the second portion is convex and extends between the toe and heel portions of the club head. In FIG. 13, the club head 402 has a second portion 420 which is rectangular and in FIG. 14 the club head 502 has a second portion 520 which does not extend between the toe and heel. Any geometric shape can be used for the second portion and its extent across the rear surface of the club head may vary. The important point is that the second portion extends vertically to or above the impact area of the club face.

Figure 15:
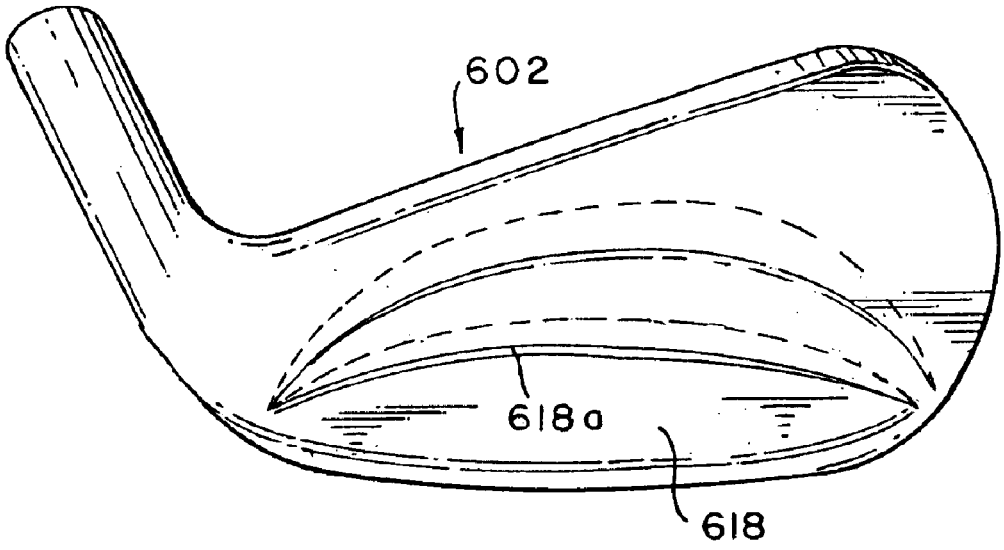
Figure 16:
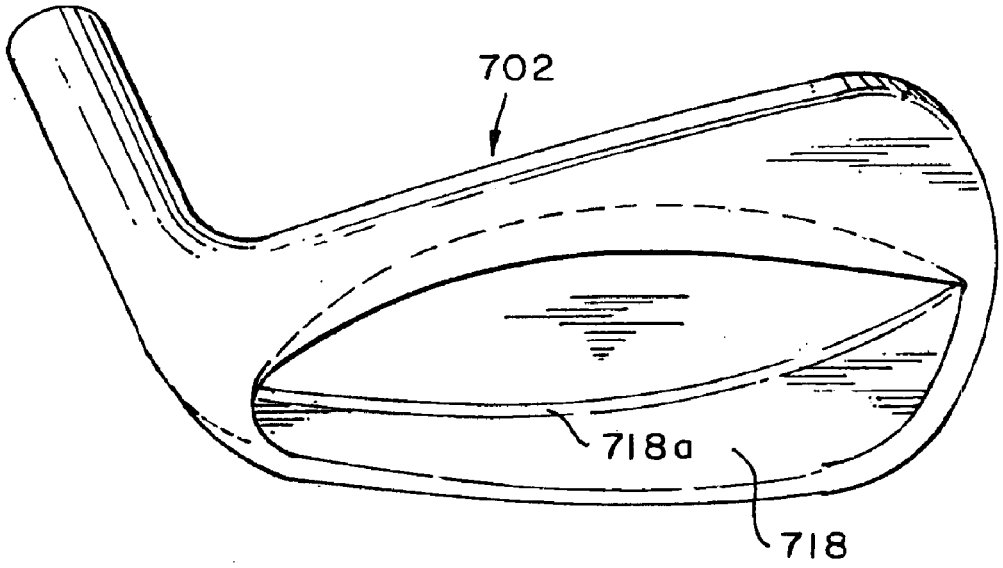

In FIGS. 15 and 16 are shown alternate configurations for the upper edge of the first portion of the rear of the club head. More particularly, FIG. 15 shows a club head 602 having a first portion 618 whose upper edge 618*a* has a convex configuration and FIG. 16 shows a club head 702 having a first portion 718 whose upper edge 718*a* has a concave configuration.

The set of golf club heads can be formed of any suitable material and by any forming process. Preferably, the iron heads are formed of forged metal such as carbon steel in order to increase the feel provided to the golfer. When executing a golf shot, the progressively increasing weight pad and thickness of the sole of the heads through the set enable the golfer to work the ball more easily.

While the preferred forms and embodiments of the invention have been illustrated and described, it will be apparent to those of ordinary skill in the art, that various changes and modifications may be made without deviating from the inventive concepts set forth above.

What is claimed is:

1. A set of blade-iron type golf clubs comprising a plurality of short irons, a plurality of mid-irons and a plurality of long irons, each of the plurality of short irons, mid-irons and long irons comprising:

a golf club head comprising a body forged of a metal material, the body having a top portion, a bottom portion, a toe portion, a heel portion, a front striking face and a rear surface, the rear surface consisting essentially of a first portion, a second portion, a third portion and a fourth portion, the first portion positioned adjacent to the bottom portion of the body and defining the thickest portion of the body, the first portion having a substantially linear upper edge extending between the toe portion and the heel portion, the second portion positioned adjacent the first portion and having an upper edge convex relative to the bottom portion and extending between the heel portion and the toe portion and extending vertically an impact area of the striking face, the second portion thinner than the first portion, the third portion positioned adjacent the second portion and thinner than the second portion, the fourth portion positioned adjacent the third portion and the top portion, the fourth portion the thinnest portion of the body;

wherein the height and thickness of the second portion of the body of each of the plurality of short irons, mid-irons and long irons increases through the set of blade-iron type golf clubs from a lowest number of the plurality of long irons to a highest number of the plurality of short irons;

wherein the center of gravity of the golf club head of each of the plurality of short irons, mid-irons and long irons is raised from the bottom portion to the top portion through the set of blade-iron type golf clubs from the lowest number of the plurality of long irons to the highest number of the plurality of short irons; and wherein the mass behind the impact area of the golf club head of each of the plurality of short irons, mid-irons and long irons is increased from the bottom portion to the top portion through the set of blade-iron type golf clubs from the lowest number of the plurality of long irons to the highest number of the plurality of short irons.

2. The set of blade-type iron golf clubs according to claim 1 wherein the set comprises a 3-iron through a pitching wedge.

3. The set of blade-iron type golf clubs according to claim 1 wherein the set comprises a 1-iron through a pitching wedge.

4. The set of blade-type iron golf clubs according to claim 1 wherein the third portion has an upper edge that is generally parallel to a top surface of the top portion of the body.

5. The set of blade-type iron golf clubs according to claim 1 wherein the body is forged of a carbon steel.

* * * * *